US008069860B2

(12) United States Patent
Soyak et al.

(10) Patent No.: US 8,069,860 B2
(45) Date of Patent: Dec. 6, 2011

(54) HUMIDIFICATION CONTROL DEVICE

(75) Inventors: John Soyak, Calabasas, CA (US); Matthew Bogosian, Studio City, CA (US)

(73) Assignee: Fuente Marketing Ltd., Turks & Caicos Islands ( * ) Notice: Subject to any disclaimer, the term of this patent is extended or adjusted under 35 U.S.C. 154(b) by 661 days.

(21) Appl. No.: 12/074,072

(22) Filed: Mar. 3, 2008

(65) Prior Publication Data

US 2009/0217934 A1 Sep. 3, 2009

(51) Int. Cl.
*A24F 13/00* (2006.01)
*A24F 25/00* (2006.01)

(52) U.S. Cl. ..... 131/329; 215/6; 312/31.1; 312/31.2; 312/31.3

(58) Field of Classification Search ..... 131/329; 215/6; 312/31.1–31.3; D27/186
See application file for complete search history.

(56) References Cited

U.S. PATENT DOCUMENTS 1,648,655 A * 11/1927 Menzies ..... 131/300
1,699,090 A * 1/1929 Bender ..... 131/275
1,999,135 A * 4/1935 Back ..... 312/31
5,881,868 A 3/1999 Soyak et al.
5,957,277 A * 9/1999 Elliott ..... 206/205
5,957,380 A * 9/1999 Fitterman et al. ..... 239/55

* cited by examiner

*Primary Examiner* — Richard Crispino
*Assistant Examiner* — Dionne Walls Mayes
(74) *Attorney, Agent, or Firm* — Finnegan, Henderson, Farabow, Garrett & Dunner, L.L.P.

(57) ABSTRACT

A humidification control device comprising a container with a chamber for storing and dispensing liquids and a base section in which is formed an opening with a contact surface around the opening's periphery. Also provided is a cigar having at least one exposed cut end and a receptacle, which is hermetically sealed, inside the container's chamber for receiving and retaining the cigar. Additionally provided is a closure plug having a tubular housing member with a closed bottom, a top with an opening and a projecting flange for engaging the opening in the base section conformable to the shape of the area of the container peripheral to the opening. The device includes a humidification source and a tubular case, which is adapted to releasably join with the tubular housing member of the closure plug, for holding the humidification source, and an opening defined by a projecting rim in the tubular case through which the humidification vapors may freely pass. The projecting rim is adapted to be placed in or in near abutment with the exposed cut end of the cigar to enable the direct flow of the humidification vapors into and throughout the cigar.

18 Claims, 4 Drawing Sheets

HUMIDIFICATION CONTROL DEVICE

BACKGROUND OF THE INVENTION

1. Field of the Invention

The present invention relates generally to a vessel for containing and dispensing liquid in combination with a receptacle for holding a tobacco product like a cigar and, more particularly, for a humidification and control device for use in maintaining the freshness of the cigar.

2. Description of the Prior Art

Cigar smoking has become increasingly more popular over the past several years, with cigar production and sales continuing to escalate at an accelerated pace. Cigars are enjoyed in a variety of ways, including after a meal, with coffee, and especially with an alcoholic beverage such as wine, liquor, or an aperitif. Traditionally, liquor and other spirits have often been marketed in their own uniquely packaged containers. Some brands use specially designed containers, typically glass bottles, that may vary in size and shape to enhance product identity by distinguishing one product from another. Examples of these are the Chevas Regal, Crown Royal and Jack Daniels brands.

Cigars, like alcoholic beverages, have always been sold and distributed as an entirely separate product, either as an individual item or in boxes, for example, of 20 or 25 cigars. Individual cigars are often packaged in cellophane wrappers or in metal tubes to keep in their freshness and preserve their quality. The tubes usually bear the name of the cigar brand, including a logo, and some additional interesting and attractive graphics to give the container a more unique appearance. The same applies to cigar boxes and similar types of containers.

U.S. Pat. No. 5,881,868 issued to Soyak and Bogosian on Mar. 16, 1999 (the "'868 patent) teaches a device that provides the means to package certain alcoholic beverages and cigar products together in a single container, and the means to store and keep the cigar fresh in a humidified environment within a separate and secure vessel inside the container. Despite the advancement in the art disclosed and claimed in the '868 patent, problems persist in maintaining the freshness and integrity of the tobacco product over extended periods. One example regards the difficulty in maintaining an airtight seal over the opening of the receptacle formed within the bottom of the bottle. Also, there are issues with the long-term capability of the humidification source. Still another problem regards the difficulty in holding the tobacco product, in this example, a cigar, securely within the receptacle to preclude damage when jostled excessively during transit. These and other problems in the prior art demand the need for improvements, which are addressed by the present invention.

Thus, the present invention provides the means to improve and sustain the humidification of the tobacco product held within the receptacle of the liquid containing vessel, in our example, a bottle containing an alcoholic beverage and the tobacco product, a cigar, the means to better secure the product within the receptacle to avoid damage, which can be costly if the product is an expensive premium cigar, and the means to improve the airtight condition of the seal over the opening at the base of the receptacle to ensure the integrity and freshness of the product inside.

SUMMARY OF THE INVENTION

The present invention provides for a humidification control device for use in a vessel containing a cigar comprising a container having a main chamber for storing and dispensing liquids and a base section, which defines an opening with a contact surface around the opening's periphery. Also included is a cigar either with both ends closed or sealed or having at least one exposed or unsealed end and a receptacle, which can be hermetically sealed, inside the main chamber of the container and extending vertically above the opening in the base section for receiving and retaining the cigar. Additionally provided is a closure plug having a tubular housing member with a closed bottom, a top defining an opening and an integrally projecting flange adapted to engage the opening in the base section conformable to the shape of the contact surface. The device also includes a humidification means and a tubular case for holding the humidification means, which includes surrounding walls, a bottom member and a top member, and an opening in the tubular case through which the humidification vapors may freely pass. The tubular case is adapted to releasably join with the tubular housing member of the closure plug.

The opening in the tubular case, which is typically defined by a projecting rim, is formed within the top member. The projecting rim is adapted to be placed in or in near abutment with the exposed or open end of the cigar to enable the concentrated and direct flow of the humidification vapors into and throughout the cigar. Even with a cigar having two sealed or closed ends, the close proximity between the vapor source and the end of the cigar helps the vapors permeate the cigar more effectively.

Accordingly, it is the object of the present invention to provide an improved humidification control device within a hermetically sealed receptacle formed within a liquid container.

Another object of the present invention is to provide an improved humidification control device to ensure long-term freshness of a tobacco product, for example, a cigar, within the hermetically sealed receptacle of a liquid container.

A further object of the present invention is to provide an improved humidification control device that also acts to stabilize a cigar within the hermetically sealed receptacle of a liquid container.

A still further object of the present invention is to provide an improved humidification control device that concentrates and directs the flow of humidification vapors to fully impregnate the cigar held within the hermetically sealed environment.

A still further object of the present invention is to provide an improved humidification control device that is easy and economical to manufacture.

A still further object of the present invention is to provide an improved humidification control device that is easy to install and maintain.

Other objects and advantages of the present invention will become apparent in the following specifications when considered in light of the attached drawings wherein the preferred embodiment of the invention is illustrated.

DETAILED DESCRIPTION OF THE PREFERRED EMBODIMENT

Figure 1:
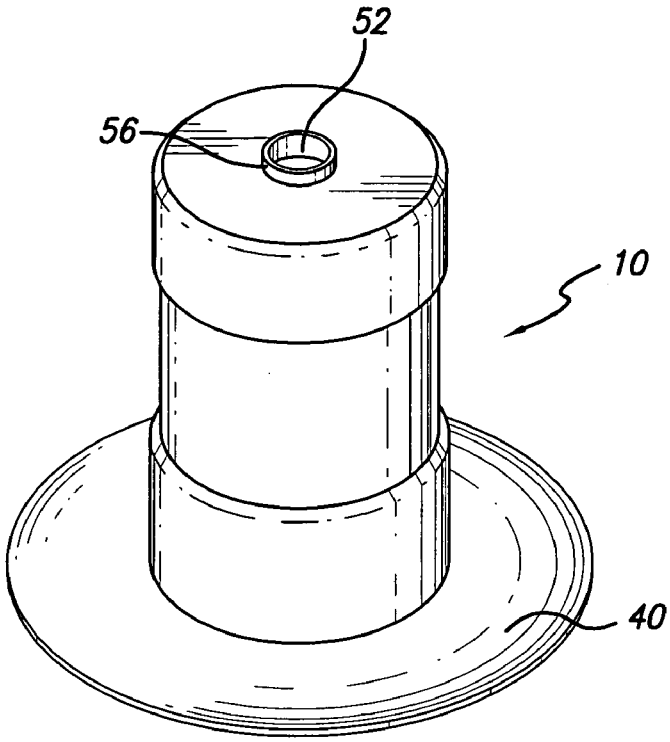
FIG. 1 is a front perspective view of the humidification control device of the present invention.
Figure 2:
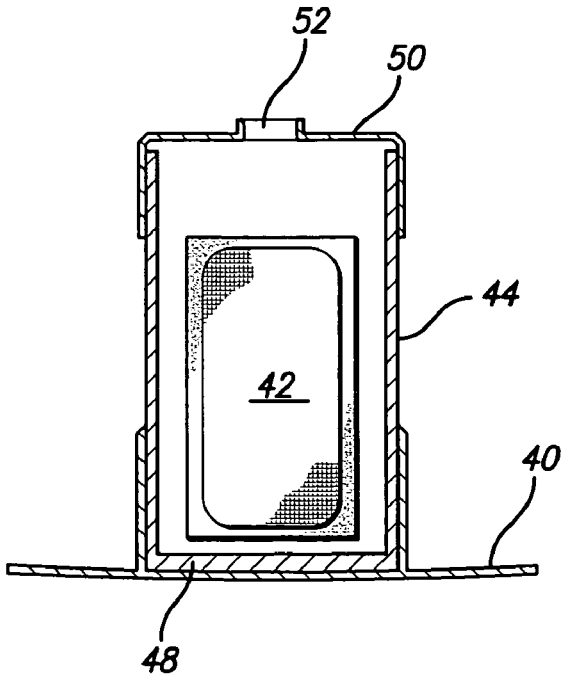
FIG. 2 is a cross-sectional view of the humidification control device of the present invention.
Figure 3:
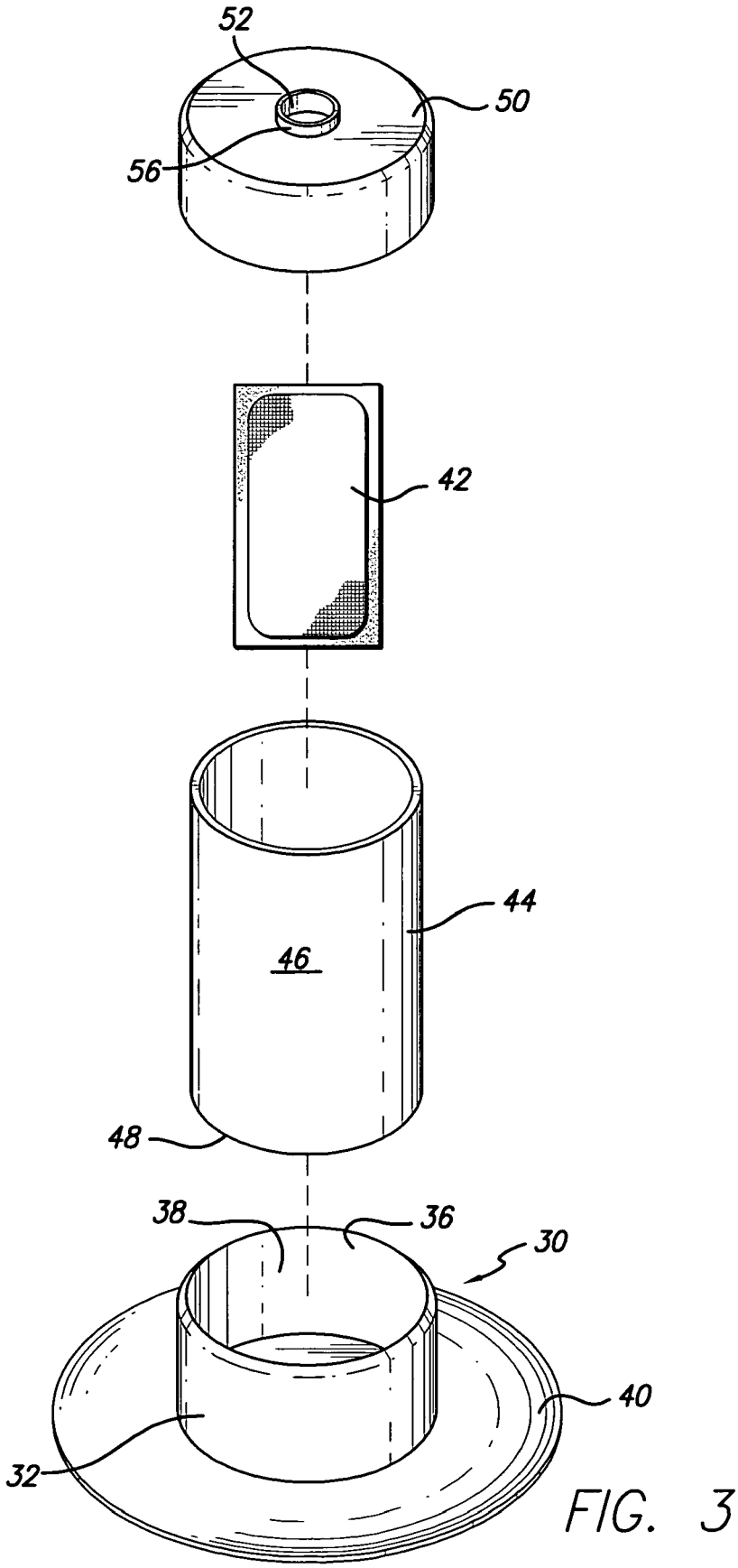
FIG. 3 is an exploded view of the component elements of the humidification control device of the present invention.
Figure 4:
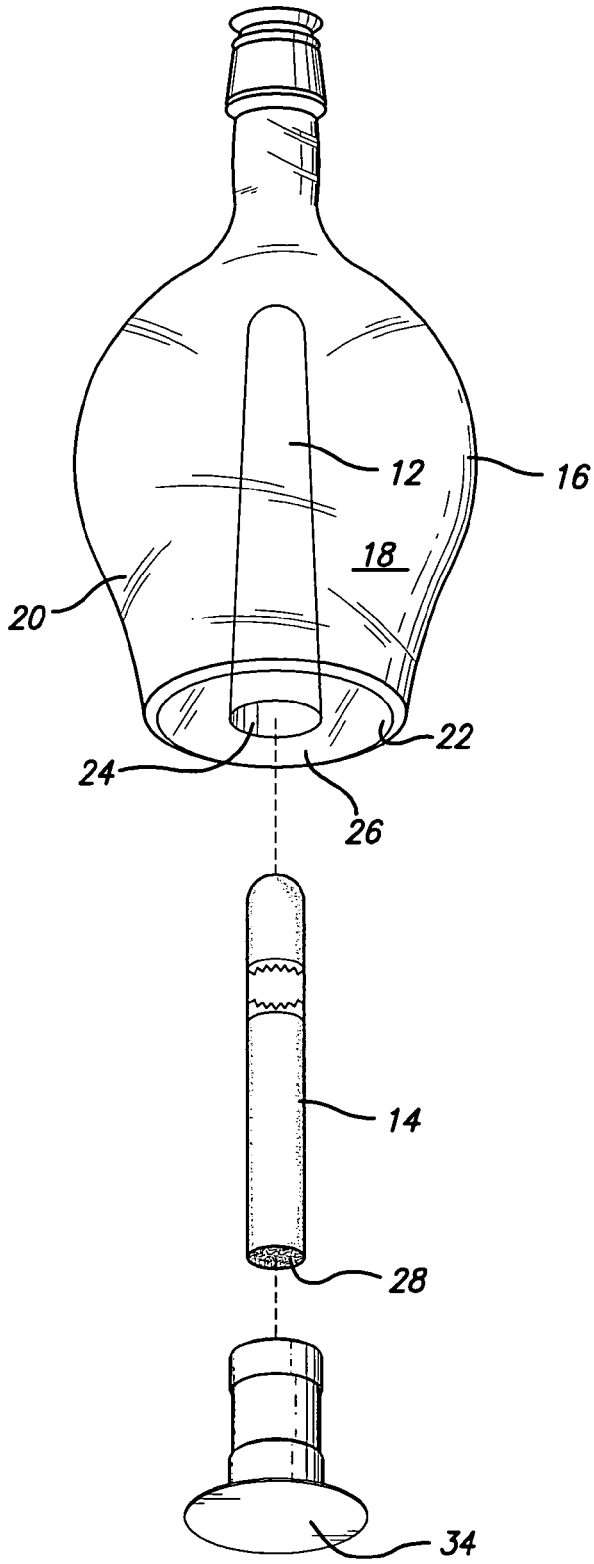
FIG. 4 is a perspective view of the humidification control device of the present invention shown in interrelation with a cigar, the cigar receptacle and a liquid container.
Figure 5:
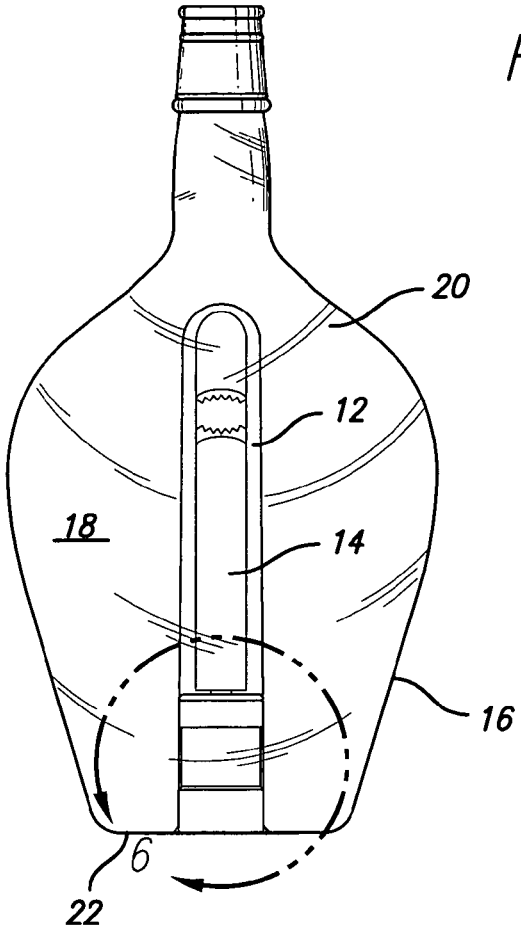
FIG. 5 is an elevational view of the humidification control device of the present invention in combination with the cigar inside the hermetically sealed receptacle within the liquid container.
Figure 6:
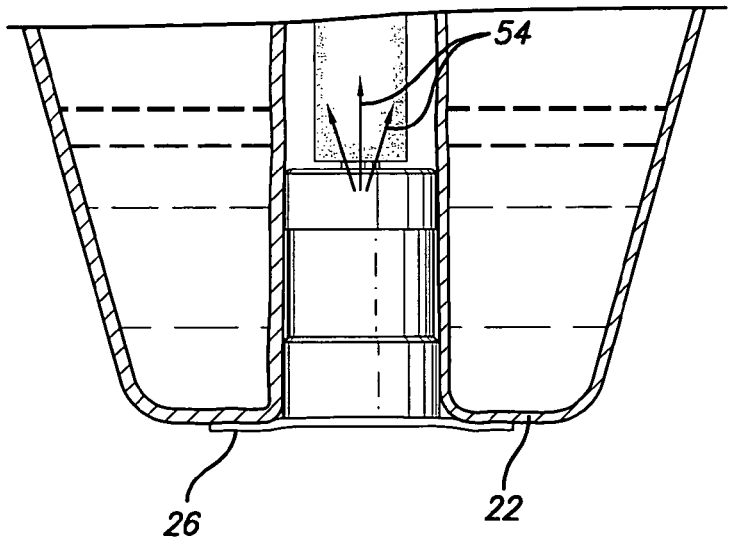
FIG. 6 is an enlarged cross-sectional view of the humidification control device of the present invention corresponding to the encircled section indicated by line 6 of FIG. 5.

A humidification control device 10 for use in a receptacle 12 containing a cigar 14 comprises a container 16, which is typically transparent but need not be, having a main chamber 18 for storing and dispensing a liquid 20 and base section 22. Base section 22 defines an opening 24 with a contact surface 26 around the periphery of opening 24. Cigar 14, in one example, has at least one exposed or cut end 28. Receptacle 12 hermetically sealable inside main chamber 18 extends vertically above opening 24 in base section 22 for receiving and retaining cigar 14. Closure plug 30 includes tubular housing member 32 with closed bottom 34, top 36, which defines opening 38. Closure plug 30 also includes an integrally projecting flange 40, which together with tubular housing member 32, are adapted to engage and penetrate opening 24 in base section 22 conformable to the shape of contact surface 26. Humidification means 42 is also provided along with tubular case 44 for holding humidification means 42. Tubular case 44 includes surrounding walls 46, bottom member 48 and top member 50 along with opening 52 through which humidification vapors 54 may freely pass. Tubular case 44 is adapted to releasably join with tubular housing member 32 of closure plug 30.

Opening 52 is defined by projecting rim 56 formed within top member 50. Tubular case 44 is adapted to be positioned in or in near abutment with exposed end 28 of cigar 14 to enable the concentrated and direct flow of humidification vapors 54 into cigar 14 and ultimately the complete impregnation of the humidification vapors 54 throughout the cigar. Even with cigars with both ends sealed, close physical proximity between the humidification source of the present invention and cigar 14 will aid the vapors to better permeate the cigar.

Closure plug 30 may be comprised of a wide variety of synthetic or natural materials, so long as they are conformable to the normally irregular surfaces of the bottom of the liquid containing vessel (or bottle) to ensure a secure and hermetic seal. Food grade materials are preferable.

Cigar 14 may be wrapped in a cedar material (not shown), which both absorbs the humidification vapors 54 and aids in retaining the vapors within the mass of cigar 14.

While the invention will be described in connection with a certain preferred embodiment, it is to be understood that it is not intended to limit the invention to that particular embodiment. Rather, it is intended to cover all alternatives, modifications and equivalents as may be included within the spirit and scope of the invention as defined by the appended claims.

The invention claimed is:

1. A humidification control device for use in a vessel containing a cigar, the device comprising:

a container having a main chamber for storing and dispensing liquids and a base section, said base section defining an opening with a contact surface around the periphery of said opening;

a cigar, said cigar having at least one exposed unsealed end;

a receptacle being sealable in vacuum tight relation inside said main chamber and extending vertically above said opening in said base section for receiving and retaining said cigar;

a closure plug having a tubular housing member with a closed bottom, a top defining an opening, and an integrally projecting flange being adapted to engage said opening in said base section conformable to the shape of said contact surface;

a humidification means; and, a tubular case for holding said humidification means, said tubular case having surrounding walls, a bottom member and a top member, and an opening in said tubular case through which humidification vapors may freely pass, said tubular case adapted to releasably join with said tubular housing member of said closure plug, wherein said opening in said tubular case is defined by a projecting rim.

2. The humidification control device of claim 1 wherein said opening in said tubular case is formed within said top member, said top member being adapted in or in near abutment with said exposed unsealed end of said cigar to enable the concentrated and direct flow of said humidification vapors into said cigar.

3. The humidification control device of claim 1 wherein said closure plug is comprised of a food grade material.

4. The humidification control device of claim 1 where said cigar is wrapped in a cedar material.

5. The humidification control device of claim 1 wherein said container is transparent.

6. A humidification control device for use in a vessel containing a cigar, the device comprising:

a container having a main chamber for storing and dispensing liquids and a base section, said base section defining an opening with a contact surface around the periphery of said opening;

a cigar, said cigar having at least one end;

a receptacle being sealable in vacuum tight relation inside said main chamber and extending vertically above said opening in said base section for receiving and retaining said cigar;

a closure plug having a tubular housing member with a closed bottom, a top defining an opening, and an integrally projecting flange being adapted to engage said opening in said base section conformable to the shape of said contact surface;

a humidification means; and, a tubular case for holding said humidification means, said tubular case having surrounding walls, a bottom member and a top member, and an opening in said tubular case through which humidification vapors may freely pass, said tubular case adapted to releasably join with said tubular housing member of said closure plug, wherein said opening in said tubular case is defined by a projecting rim.

7. The humidification control device of claim 6 wherein said opening in said tubular case is formed within said top member, said top member being adapted in or in near abutment with said end of said cigar to enable the concentrated and direct flow of said humidification vapors to permeate said cigar.

8. A device for containing liquid and a cigar, the device comprising:

a container comprising a main chamber configured to contain liquid, a section having an opening, and a contact surface around the opening;

a receptacle extending from the opening of the container into the main chamber, the receptacle being configured to receive a cigar;

a closure plug comprising an integrally projecting flange conformable with the contact surface; and a tubular case joined to the closure plug, the tubular case comprising walls, a top member, and an opening through which vapors can flow, wherein the opening is defined by a projecting rim, wherein the tubular case is configured to provide concentrated and direct flow of humidification vapors from inside the tubular case into a cigar received in the receptacle.

9. The device of claim 8, wherein the opening in the tubular case is formed in the top member, the top member being configured to facilitate flow of the humidification vapors into a cigar.

10. The device of claim 8, wherein the closure plug comprises food grade material.

11. The device of claim 8, wherein the container is transparent.

12. The device of claim 8, wherein the section comprises a base section of the container.

13. The device of claim 8, wherein the integrally projecting flange is configured to provide a seal between the closure plug and the contact surface of the container.

14. The device of claim 13, wherein the seal is hermetic.

15. The device of claim 8, wherein the closure plug comprises a tubular housing member.

16. The device of claim 8, wherein the tubular case contains a humidification source.

17. A product comprising:

the device of claim 8;

liquid contained in the container; and a cigar contained in the receptacle.

18. The product of claim 17, further comprising a humidification source in the tubular case.

* * * * *